United States Patent [19]

Wilde

[11] 4,140,650

[45] Feb. 20, 1979

[54] PROCESS FOR MANUFACTURE OF DETERGENT POWDERS

[75] Inventor: Raymond J. Wilde, Wirral, England

[73] Assignee: Lever Brothers Company, New York, N.Y.

[21] Appl. No.: 854,943

[22] Filed: Nov. 25, 1977

[30] Foreign Application Priority Data

Nov. 26, 1976 [GB] United Kingdom ..... 49425/76

[51] Int. Cl.² ..... C11D 3/075; C11D 1/83; C11D 11/02

[52] U.S. Cl. ..... 252/135; 252/89 R; 252/527; 252/546; 252/DIG. 1

[58] Field of Search ..... 252/89, 135, 539, DIG. 1

[56] References Cited

U.S. PATENT DOCUMENTS

| | | | |
|---|---|---|---|
| 3,579,453 | 5/1971 | Dupre et al. | 252/89 |
| 3,741,913 | 6/1973 | Waag | 252/544 |
| 3,844,969 | 10/1974 | Griffiths et al. | 252/108 |
| 3,849,327 | 11/1974 | DiSalvo et al. | 252/109 |
| 3,962,149 | 6/1976 | Chirash et al. | 252/540 |

FOREIGN PATENT DOCUMENTS 1939973 2/1970 Fed. Rep. of Germany.

*Primary Examiner*—P.E. Willis, Jr.
*Attorney, Agent, or Firm*—Kenneth F. Dusyn; James J. Farrell; Melvin H. Kurtz

[57] ABSTRACT

The invention relates to the preparation of spray-dried powders of low bulk density. Fabric washing powders containing nonionic surfactants as the major or sole detergent-active species have unacceptably high natural bulk densities (about 0.6 g/l). It has been found that the incorporation of certain alkenyl succinate salts into the crutcher slurry can reduce the bulk density of the resultant spray-dried powder. There is also a need for absorbents of low bulk density for manufacturing nonionic-surfactant based powders by dry-mixing routes and it has been found that suitable absorbents can be prepared by adding alkenyl succinate to a slurry of the chosen ingredients and spray-drying.

7 Claims, No Drawings

PROCESS FOR MANUFACTURE OF DETERGENT POWDERS

This invention relates to a process for the production of detergent powders and to the powders obtained.

The introduction of fabric washing detergent powders based on nonionic surfactants has raised a number of problems for the industry. Nonionic surfactants are volatile and fairly easily oxidisable, two properties which make them not especially suitable for incorporation into a crutcher slurry which is to be spray-dried. This problem has lead most of the big manufacturers to experiment with processes for making nonionic surfactant based powders which do not involve passing the surfactant through the spray-drying tower. The patent literature is replete with proposals for incorporating nonionic surfactants into powders by dry-mixing processes such as granulation or noodling or by processes involving spraying the nonionic, in molten or solution form onto a suitable, usually spray-dried, absorbent.

In the case of spraying, a disadvantage which can arise is that the impregnated absorbent has rather a high bulk density.

On the other hand most of the big manufacturers have large investments in spray-drying capacity and consequently are motiviated to use this capacity to the fullest extent possible.

Thus although the "dry-mixing" and "spraying-on" routes referred to previously seem attractive in theory, in practice the few nonionic-surfactant based powders which are on the market have generally been prepared by a spray-drying route. In addition to the penalties already mentioned, spray-drying of nonionic-surfactant based slurries has another disadvantage which must be overcome — the resultant powders tend to be of too high a bulk density (~0.55–0.60 g/l).

Thus whichever way the processing of nonionic surfactant-based powders is approached, by a dry-mixing, spray-on or spray-drying route, the same problem is encountered — excessive bulk density.

We have now discovered a group of compounds which can assist in reducing the bulk density of spray-dried slurries containing inorganic materials and in particular such slurries containing nonionic surfactants.

According to the present invention there is provided a process for the manufacture of a detergent powder by spray-drying an aqueous slurry of detergent powder ingredients optionally including from up to 20% by weight of the dry powder of an alkoxylated alcohol or phenol nonionic surfactant, wherein the slurry also includes from ½–5% by weight based on the spray-dried powder of a mono- or di-alkali metal or ammonium salt of a dicarboxylic acid of the general formula: $R.CH(COOH).(CH_2)_n.COOH$ where n is 0 or 1 and R is a primary or secondary straight chain alkyl or alkenyl group containing from 10 to 20 carbon atoms. Preferred dicarboxylic acids are those described in our British Pat. No. 1,293,753.

The dicarboxylic acids of the invention are known compounds. They can be prepared by standard methods which include the condensation of a straight-chain olefine with maleic acid or maleic anhydride to give an alkene-1,2-dicarboxylic acid, or with malonic acid to give an alkene-1,1-dicarboxylic acid. Alkane, and alkene, 1,1-dicarboxylic acids can be prepared by a standard malonic ester synthesis.

As has been said, these dicarboxylic acids help to reduce the bulk density of detergent slurries containing inorganic materials and more particularly, inorganic materials and nonionic surfactants. Such materials can be sodium tripolyphosphate, sodium pyrophosphate, sodium orthophosphate, sodium carbonate, sodium silicate of varying sodium oxide to silica ratios and sodium sulphate, or mixtures of any of these materials.

The alcohols from which the nonionic surfactants can be prepared can be primary or secondary alcohols containing straight or branched carbon chains. The number of carbon atoms will generally be from about 7 to about 24, preferably from about 8 to 18 and most preferably from about 12 to 16. These alcohols may be the so-called synthetic alcohols made by the well known Ziegler or Oxo processes, or the so-called "natural alcohols."

The alkoxylation reaction will be carried out by conventional means, generally using ethylene oxide or propylene oxide. The degree of ethoxylation can vary widely both from one hydrophobe to another and even when using a single hydrophobe. Thus ethylene oxide chains containing as few as 1 and more than 20 ethylene oxide units are quite often found in nonionic surfactants (although 5 to 15 is the preferred range) and will be applicable here.

The choice of carbon chain length of the hydrophobe and the chain length of the hydrophobic alkoxy chain is largely determined by the detergent properties required of the molecule. The relationship between the chain length of the hydrophobic part of the molecule and that of the hydrophilic part can be expressed numerically as the hydrophilic lipophilic balance (HLB). A rough and ready way of determining the HLB is to use the expression $$HLB = \frac{\text{Wt percentage of ethylene oxide}}{5}$$

Nonionic surfactants which are suitable for use in heavy duty fabric washing powders generally have an HLB in the range up to 13, although HLBs outside this range are not excluded.

An additional factor in the choice of nonionic surfactant is that alcohols containing both short carbon and short ethoxylate chain lengths are relatively low boiling and can volatilise under the conditions prevailing in a spray drying tower.

Hence alcohols containing less than about 8 carbon atoms will not normally be chosen unless their ethoxy chains contain at least about 8 ethylene oxide units.

Preferred alcohol ethoxylates for use in this invention are derived from the following series.

Tergitols TM which are a series of ethoxylates of secondary alcohols sold by the Union Carbide Corporation, especially Tergitol 15-S-7, 15-S-9, 15-S-12 and 15-S-15 which are ethoxylates of a mixture of C11-15 alcohols and Tergitols 45-S-7, 45-S-15 which are ethoxylates of a mixture of C14 and C15 alcohols, the degree of ethoxylation being shown by the postscript.

Ethoxylates of primary alcohols made by the Oxo process and containing about 20% of alpha branched material sold by Shell Chemicals Ltd. (Dobanols TM) and Shell Chemicals Inc. (Neodols TM), especially Dobanol and Neodol 25-7, 25-9, 25-12 and 25-15 which are ethoxylates of a mixture of $C_{12}$–$C_{15}$ alcohols and Dobanol 45-7, 45-9, 25-12 and 25-15 which are ethoxylates of a mixture of $C_{14-15}$ alcohols.

Ukanils TM which are a series of ethoxylates of Oxo alcohols containing about 40% of alpha alkyl branched material manufactured by ethoxylation of, for example, Acropols TM especially Acropol 35 which is a $C_{13}$–$C_{15}$ alcohol mixture.

Synperonics TM, a series of ethoxylates of alcohols containing 45–55% of alkyl branching, mostly methyl branching, sold by Imperial Chemical Industries Limited, especially those based on a $C_{13-15}$ mixture of alcohols and ethoxylated to 7, 9, 11 and 15 units of ethylene oxide.

Alfols TM which are ethoxylates of primary Ziegler alcohols derived by oxidative polymerisation of ethylene, manufactured by Conoco-Condea, especially Alfol 12/14-7, 12/14-9, 12/14-12, 12/14-15 and Alfol 14/12-7, 14/12-9, 14/12-12, 14/12-15 which are ethoxylates of mixtures of $C_{12}$ and $C_{14}$ alcohols. Ethoxylates of primary Oxo alcohols about 50% branched, mainly $\alpha$ methyl sometimes called Lials TM produced from olefins manufactured by Liquichemica.

Lutensols TM which are a series of $C_{13-15}$ alcohol ethoxylates prepared by the "Oxo" process from an olefin produced by the polymerisation of ethylene, manufactured by Badische Anilin und Soda Fabrik GmbH, especially Lutensol AO 8 and 12.

The required HLB can be achieved not only by selecting the carbon chain length of the hydrophobe and the length of the ethyleneoxy chain in a single or substantially single material (because of the nature of their process of production, all nonionic surfactants which are spoken of as if they were single substances are in fact mixtures). It can also be achieved by deliberately taking two "nonionic substances" of widely differing HLBs and mixing them. This approach is described in our own British patent application No. 16641/76, Netherlands patent application No. 7413522 and in Netherlands patent application No. 7406003. It is also possible to obtain the required HLB by "stripping" some chain lengths from a nonionic surfactant mixture as described in patent applications based on U.S. Ser. No. 453,464 and U.S. Pat. No. 3,682,849.

Other components of detergent compositions can be added to the slurry or post-dosed into the spray-dried base powder according to their known suitability for undergoing a spray-drying process. Examples of such components are oxidising bleaches such as sodium perborate and percarbonate optionally with bleach precursors such as tetra acetyl ethylene diamine, and tetra acetyl glycoluril, suds suppressors such as silicone oils, alkyl phosphates and micro-crystalline waxes and combinations thereof, soil suspending agents such as sodium carboxymethyl cellulose, cellulose ethers and copolymers of maleic anhydride with ethylene or methyl vinyl ether, enzymes such as those sold uner the trade names "Alcalase," and "Esperase" (SP72), by Novo Industries A/S, Denmark, and Fluorescers, and alkyl ethanolamide.

These conventional and optional components of the detergent compositions can be present together in an amount of from 15 to 50% by weight of the finished compositions when an oxidising bleach is present or at substantially greater levels in the absence of such bleach.

The invention will be further described with reference to the following Examples.

EXAMPLE 1

Two slurries were made up to the following formulation.

| | Parts By Weight | |
|---|---|---|
| | A | B |
| Sodium tripolyphosphate | 33.0 | 33.0 |
| Anhydrous alkaline silicate | 5.0 | 5.0 |
| Sodium sulphate | 12.8 | 12.8 |
| SCMC | 0.5 | 0.5 |
| Fluorescer | 0.6 | 0.6 |
| Sodium hexedecenyl succinate | — | 2.0 |
| Water | 52.0 | 50.0 |

The slurries were then aerated and spray-dried. The bulk densities of the resultant powders were:

| | A | B |
|---|---|---|
| Bulk density (g/l) | 0.51 | 0.32 |

The powder produced from slurry B was then sprayed with a mixture of 10.7 parts of Synperonic 7EO ® and 1.5 parts of tallow ethanolamide. The resultant mixture was then dosed with 29.5 parts of sodium percarbonate giving a fully satisfactory heavy duty fabric washing product.

EXAMPLE 2

Two slurries were made up to the following formulation.

| | % by weight | |
|---|---|---|
| | A | B |
| C14–15 primary alcohol ethoxylated with an average of 7 moles of ethylene oxide | 16.8 | 16.8 |
| Sodium tripolyphosphate | 30.0 | 30.0 |
| Sodium hexedecenyl succinate | — | 2.0 |
| Sodium silicate ($SiO_2$:$Na_2O$,2:0) | 10.0 | 10.0 |
| Sodium carboxymethyl allulose | 1.0 | 1.0 |
| Coconut monoethanolamide | 1.5 | 1.5 |
| Water and miscellaneous minor ingredients | Balance to 100 | |

The slurries were then aerated and spray-dried. The bulk densities of the resultant powders were

| | A | B |
|---|---|---|
| Bulk density (g/l) | 0.51 | 0.32 |

The reduction of bulk density obtainable by the use of sodium hexedecenyl succinate can be clearly seen.

What is claimed is:

1. A process for the manufacture of a detergent powder comprising the steps of (a) forming an aqueous slurry comprising an ingredient of sodium tripolyphosphate, sodium pyrophosphate, sodium orthophosphate, sodium carbonate, sodium silicate or sodium sulphate, or a mixture thereof, and from ½ to 5% by weight of said ingredient of a mono- or di-alkali metal or ammonium salt of a dicarboxylic acid of the general formula R.CH(COOH). $(CH_2)_n$.COOH where n is 0 or 1, and R is a primary or secondary straight chain alkyl or alkenyl group containing from 10 to 20 carbon atoms;

(b) spray drying the resultant slurry to form a spray dried powder; and (c) combining said spray dried powder with a $C_7$ to $C_{24}$ primary or secondary alcohol ethoxylated with from 1 to 20 moles of ethylene oxide per mole of alcohol.

2. A process according to claim 1 wherein the ethoxylated alcohol comprises from 5 to 15% by weight of the detergent powder.

3. A process according to claim 1, wherein the ethoxylated alcohol comprises a $C_8$ to $C_{18}$ alcohol ethoxylated with an average of from 5 to 15 moles of ethylene oxide per mole of alcohol.

4. A process according to claim 1 wherein the ethoxylated alcohol has a hydrophobic-lipophilic balance of up to 13.

5. A process for the manufacture of a detergent powder comprising the steps of (a) forming an aqueous crutcher slurry comprising an ingredient of sodium tripolyphosphate, sodium pyrophosphate, sodium orthophosphate, sodium carbonate, sodium silicate or sodium sulphate, or a mixture thereof, from 5 to 15%, based on the weight of the detergent powder, of a primary or secondary $C_7$ to $C_{24}$ alcohol ethoxylated with from 1 to 20 moles of ethylene oxide per mole of alcohol, and from ½ to 5% by weight of said ingredient of a mono- or di-alkali metal or ammonium salt of a dicarboxylic acid of the general formula $R.CH(COOH).(CH_2)_n.COOH$ where n is 0 or 1, and R is a primary or secondary straight chain alkyl or alkenyl group containing from 10 to 20 carbon atoms; and (b) spray drying the resultant slurry to form a spray dried powder.

6. A process according to claim 5 wherein the ethoxylated alcohol comprises a $C_8$ to $C_{18}$ alcohol ethoxylated with an average of from 5 to 15 moles of ethylene oxide per mole of alcohol.

7. A process according to claim 5 wherein the ethoxylated alcohol has a hydrophobic-lipophilic balance of up to 13.

* * * * *